United States Patent [19]

Ernst

[11] 4,185,458

[45] Jan. 29, 1980

[54] TURBOFAN AUGMENTOR FLAMEHOLDER

[75] Inventor: Richard C. Ernst, North Palm Beach, Fla.

[73] Assignee: The United States of America as represented by the Secretary of the Air Force, Washington, D.C.

[21] Appl. No.: 904,850

[22] Filed: May 11, 1978

[51] Int. Cl.[2] ..... F02G 3/00

[52] U.S. Cl. ..... 60/261; 60/39.72 R

[58] Field of Search ..... 60/261, 39.72 R

[56] References Cited

U.S. PATENT DOCUMENTS

| | | | |
|---|---|---|---|
| 3,002,352 | 10/1961 | Helfrich | 60/39.72 R |
| 3,085,401 | 4/1963 | Lefebvre | 60/39.72 R |
| 3,153,324 | 10/1964 | Meyer | 60/261 |
| 3,170,294 | 2/1965 | Meyer | 60/39.72 R |
| 3,295,325 | 1/1967 | Nelson | 60/261 |
| 3,485,045 | 12/1969 | Riecke | 60/261 |
| 3,800,527 | 4/1974 | Marshall | 60/39.72 R |
| 3,931,707 | 1/1976 | Vdoviak | 60/261 |

*Primary Examiner*—Douglas Hart

*Attorney, Agent, or Firm*—Joseph E. Rusz; Jacob N. Erlich

[57] ABSTRACT

A turbofan augmentor flameholder having a hollow ring-like structure of annular configuration concentric with the center line of a turbine of a turbofan engine. The ring-like structure has protruding therefrom in the radial direction a first group of hollow gutters extending in a direction toward the center line of the turbine and a second group of hollow gutters extending from the ring-like structure in a direction away from the center line and toward the outer casing of the turbofan engine. The second group of gutters have a vee-shaped angular configurated portion in a direction toward the turbine. The angular configurated portion gradually increases in angle along the gutter in the radial direction as a direct function of its distance from the ring-like structure. Such a relationship provides optimum efficiency for the dispersion of hot exhaust gases from the turbine to the flameholder for gas turbofan engine augmentation.

3 Claims, 4 Drawing Figures

FIG. 2
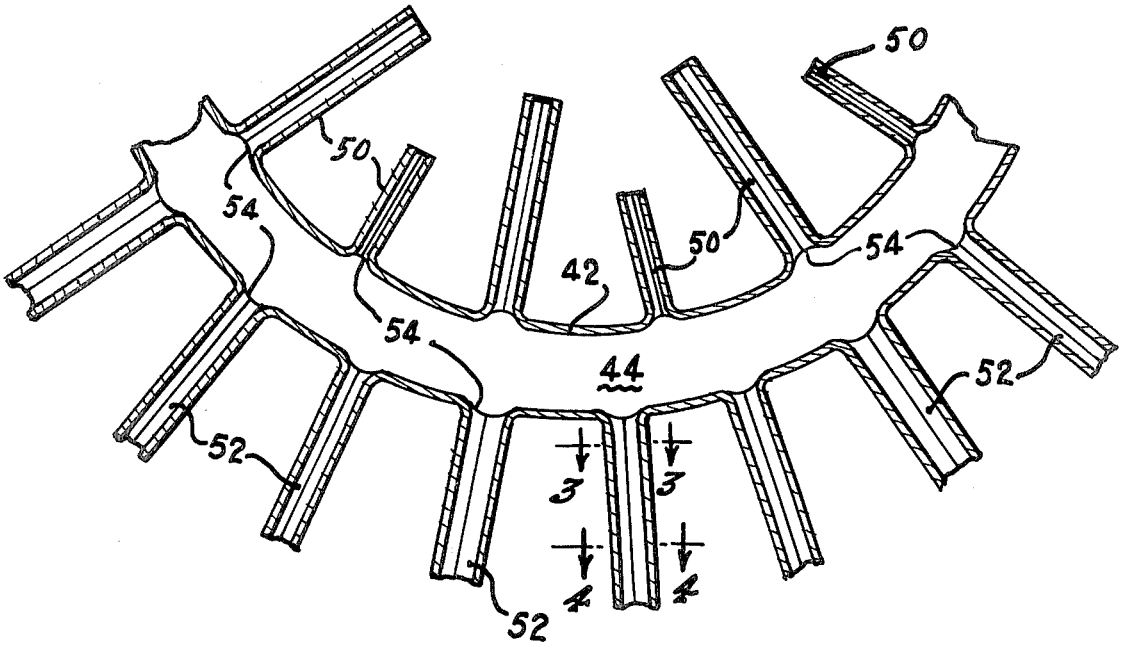
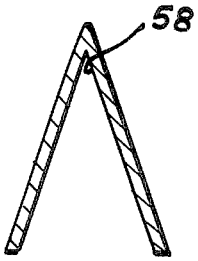
FIG. 3
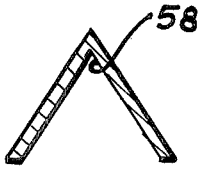
FIG. 4

TURBOFAN AUGMENTOR FLAMEHOLDER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to afterburners or augmentors, and, more particularly to a turbofan augmentor flameholder for use in a turbofan engine.

It is well known in the aircraft gas turbine art to provide thrust augmentation by burning additional fuel in an afterburner or augmentor located downstream of the engine turbine. The afterburner generally includes means for dispersing a main flow of fuel together with a flameholder to which the flame may attach. The flameholder reduce locally the velocity of the gas stream in order to sustain the flame which would otherwise blow out. Generally, the flameholder is made up of an annular pilot burner located near the outside of the hot core of the turbine engine with radial vee-gutter flameholders extending into the hot core and the cool fan duct air of the turbofan afterburner. For typical vee-gutter flameholder, the limit of flame stability is controlled by the combustion rate in the recirculation zone behind the gutter. At high altitude, the inlet pressure and temperature are reduced which results in a poor combustion rate and, thus, poor flame stability limits. It is well known that by introducing a source of heat to the recirculation zones, the reaction rate and stability limits may be increased. Unfortunately, attempts to introduce this heat source by gas migration from the adjacent hot core have resulted in either durability problems or design constraints.

Several other methods and their associated problems are listed hereinbelow:

1. The inclined flameholder: By moving the outer diameter fan duct gutter tips aft, a forced migration is directed from the core section or pilot section into the fan duct gutter wakes. Unfortunately, this method of migration produces excessive thermal loads on the walls of the augmentor downstream of the flameholder.

Forced flow via scoops: Scoops located on the pilot zone may be used to force hot flow down the fan duct radial gutters. The problems are mechanical and thermal durability of the scoops, which are located in the hot recirculation zone, are affected thereby. A secondary problem is disruption of the recirculation zone aerodynamics. As a result, the forced flow via scoops generally has not been utilized in practical applications.

It is therefore quite obvious that the current state-of-the-art turbofan augmentor flameholders leave much to be desired in that poor flame stabilization occurs in the low temperature fan duct air stream. In addition, the durability of the liner has been reduced as a result of the introduction of an additional heat source to the recirculation zone.

SUMMARY OF THE INVENTION

The turbofan augmentor flameholder of this invention overcomes the problems set forth hereinabove by providing a flameholder which improves the flame stabilization and as a result thereof improves the overall operation and liner durability of turbofan augmentors.

A conventional gas turbine engine of the type having a compressor, combustor, and turbine in axial flow relation is generally provided with thrust augmentation by an augmentor or afterburner. The augmentor, in most instances, includes a flameholder. The instant invention is directed to the flameholder. The flameholder is made of a ring-like structure having an annular configuration which is concentric with the center of the exhaust stream of the turbofan engine. The annular pilot section contains a plurality of openings therein, the openings lead to both the fan duct gutters and core gutters. The flameholder of this instant invention allows for the migration of hot gases into the fan duct gutter wake without the problems associated with the examples set forth hereinabove. The generation of hot gas flow is accomplished by providing a lower static pressure in the outer radius of the fan duct vee-gutters relative to the annular pilot section. This is accomplished by setting the apex angle of the gutter cross section at a higher value at the outer radius than in toward the central portion thereof. The increase in apex angle is a linear function of the gutter radius.

The increased apex angle of the flameholder of this invention produces a higher pressure loss coefficient at the outer radius than near the pilot, which results in hot gas migration. Such a procedure of providing a pressure loss driver for the gas flow may be provided for without the necessity of increased vee-gutter width or forced flow devices as in the past. In addition, the flow acceleration over the gutters is reduced, which promotes higher stability levels. Also, the gutter width remains constant, which results in a lower thermal load onto the augmentor walls. This eliminates the necessity for tip plates at the outer diameter of the flameholder to maintain acceptable wall temperatures. These tip plates are necessary with the increased width concept of the prior art and a source of durability problems in themselves.

It is therefore possible with the instant invention to minimize the augmentor wall thermal load by reducing the tendency for flow impingement by reducing the length of the recirculation zone within the augmentor. Means are further provided for the flameholder of this invention for introducing a main flow of fuel outside the annular pilot.

In operation, turbine exhaust gases leave the last turbine rotor of a gas turbine engine. The gases are directed into the augmentor combustion chamber through an annular duct. Cold fan air is directed into the augmentor combustion chamber through another annular duct. A portion of the fan stream is passed between a liner and a combustion chamber duct for cooling purposes. Fuel is injected into the augmentor airflow in annular regions by plurality of sprayrings. Ignition of the augmentor is accomplished by locating a sparkplug in a sheltered region adjacent the annular pilot of the flameholder of this invention.

It is therefore an object of this invention to provide a turbofan augmentor flameholder in which the flow acceleration over the gutters is reduced and thereby promotes higher stability levels.

It is a further object of this invention to provide a turbofan augmentor flameholder in which the gutter width may remain constant and still generate the desired augmentation of the reaction rate in the wake of the fan duct gutters.

It is still a further object of this invention to provide a turbofan augmentor flameholder which eliminates the necessity for tip plates at the outer diameter of the flameholder to maintain acceptable wall temperatures within the augmentor.

It is another object of this invention to provide a turbofan augmentor flameholder which is economical to produce and which utilizes conventional, currently available components that lend themselves to standard mass producing manufacturing techniques.

For a better understanding of the present invention together with other and further objects thereof, reference is made to the following description taken in connection with the accompanying drawing and its scope will be pointed out in the appended claims.

DETAILED DESCRIPTION OF THE DRAWING

FIG. 2 is an end view shown in schematic fashion of the turbofan augmentor flameholder of this invention shown partially fragmented and in cross-section;

FIG. 3 is a cross-section of the turbofan augmentor flameholder of this invention taken along line 3—3 of FIG. 2; and FIG. 4 is a cross-section of the turbofan augmentor flameholder of this invention taken along line 4—4 of FIG. 2.

DETAILED DESCRIPTION OF THE PREFERRED EMBODIMENT

Figure 1:
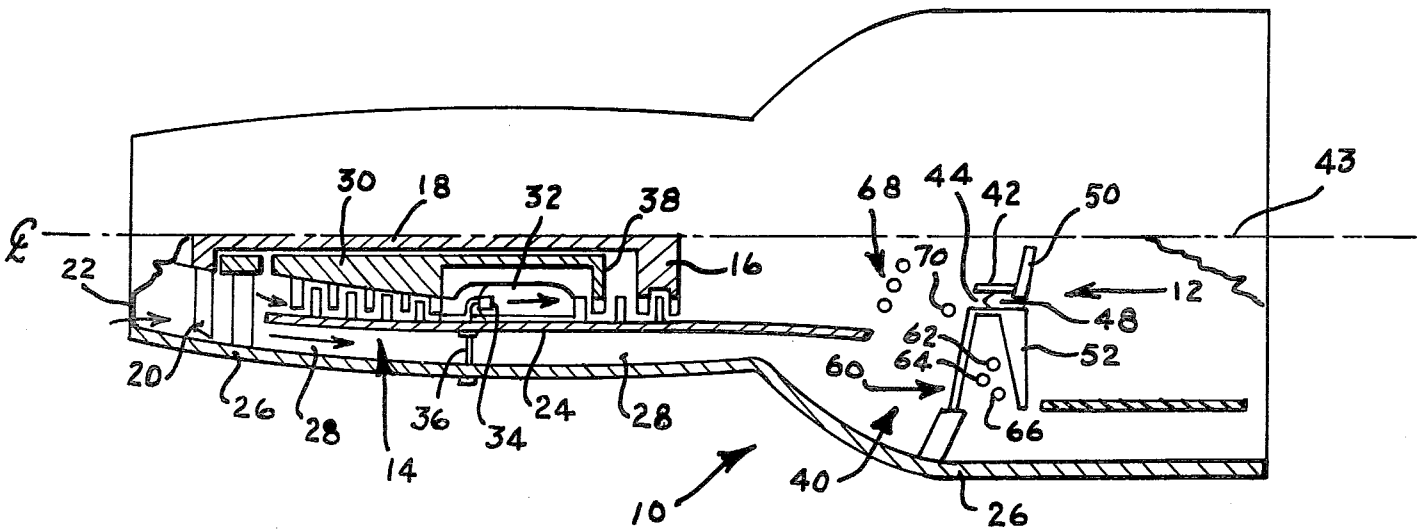
FIG. 1 is a side elevational, schematic representation of the turbofan augmentor flameholder of this invention in combination with a turbofan engine and shown partially fragmented and in cross-section.

Reference is now made to FIG. 1 of the drawing which best illustrates a conventional turbofan engine 10 which incorporates therein the turbofan augmentor flameholder 12 of this invention. Turbofan engine 10 is made up of a core engine 14 utilized for generating a hot gas stream for driving a fan turbine 16. The turbine 16 is connected to and drives rotor 18 of a fan 20 disposed at the inlet end 22 of engine 10. The core engine 14 and fan turbine 16 are disposed within an outer fairing 24. An elongated cowl, or outer casing 26 defines the engine inlet indicated at 22, and, in combination with fairing 24, defines a duct 28 concentric of core engine 14.

Turbofan engine 10 operates as follows, fan 20 pressurizes an airstream, the outer portion of which passes along duct 28 and the inner portion of which enters the core engine 14. In the core engine 14, the airstream is further compressed by a core engine compressor 30 to provide a highly pressurized airstream for supporting combustion of fuel in a combustor 32. Fuel to combustor 32 is provided by fuel injection means 34 which receives a flow of pressurized fuel from conduit 36 from a source of pressurized fuel (not shown). The hot gas stream thus generated drives a high pressure, core engine turbine 38 which is connected to the rotor of compressor 30.

The augmentor or afterburner 40 is situated at the aft end of turbofan engine 10 adjacent fan turbine 16 and provides additional thrust augmentation thereto. Augmentor 40 incorporates therein the turbofan augmentor flameholder 12 of the instant invention. Flameholder 12 is situated adjacent the hot exhaust stream emanating from turbofan engine 10.

As clearly illustrated in FIG. 1 of the drawing, flameholder 12 is formed of a hollow ring-like structure 42 of annular configuration and concentric with the center line 43 of turbine 16. Ring-like structure 42 is open at 44 in the direction of turbine 16. An annular pilot section 48 is formed in the central portion thereof. A first group of radially disposed hollow gutters 50 extend from ring-like structure 42 in a direction toward the center line 43 of turbine 16. A second group of radially disposed hollow gutters 52 extend from ring-like structure 42 in a direction away from center line 43 of turbine 16 toward outer casing 26 of turbofan 10.

As best shown in FIG. 2 of the drawing an aperture 54 is located in periphery of ring-like structure 42 aligned with each of gutter 50 and 52, respectively. Apertures 54 interconnect pilot section 42 with gutters 50 and 52, respectively.

As clearly illustrated in FIGS. 2 through 4 of the drawing each of the second group of radially disposed gutters 52 a vee-shaped angular configurated portion 58 in a direction toward turbine 16. The angular configurated portion 58 gradually increases in angle size along gutter 52 in the radial direction in direct relationship to its distance from ring-like structure 42. As a result thereof, as clearly shown in FIGS. 3 and 4 of the drawing, the width of gutter 52 remains constant. Although this invention is not limited thereto, radial gutters 50 may also include the angular relationship set forth with respect to gutters 52 with the angular size increasing in a direction away from ring-like structure 42.

Located adjacent annular pilot 48 is a conventional spark ignition system 60. Fuel is injected into the airflow of augmentor 40 in annular regions by a plurality of sprayrings 62, 64, 66, 68 and 70. Sprayring 70 is situated adjacent annular pilot 48 while the plurality of sprayrings 62, 64, and 66 are disposed radially adjacent fan duct gutter 52. Situated within the flow field of the hot gases are a plurality of fuel injection sprayrings 68.

Referring once again to FIGS. 2 through 4 of the drawing, it is clearly shown that an essential concept of this invention is to set the angle 58 of fan duct gutters 52 at a higher value at the outer radius thereof than in towards the ring-like structure 42. This increase in apex angle is a linear function of the distance from the ring-like structure 42. The increased angle 58 produces a higher pressure loss coefficient at the outer radius of gutters 52 than near pilot 48. Such a relationship results in hot gas migration to the cool fan duct air. Furthermore, the arrangement as set forth in this invention provides a pressure loss driver for the gas flow without the necessity of increased vee-gutter width or forced flow devices as in the past.

With the turbofan augmentor flameholder 12 of this invention the hot gases emanating from turbofan engine 10 enter annular pilot 48 and from there proceed into fan duct gutters 50 and 52. The generation of hot gas flow is accomplished by the provision of lower static pressure in the outer radius of the fan duct gutters 52 relative to the pilot section 48.

During operation, initial fuel is injected into augmentor 40 through sprayring 70. Augmentor ignition is accomplished by spark ignition system 60 located in a sheltered region of flameholder 12 of this invention. Upon ignition, additional fuel enters augmentor 40 in the following order through sprayrings 62, 64, 68 and 66, respectively, with the hot gases themselves providing ignition system for the rest of augmentor 40.

Although this invention has been described with reference to a particular embodiment, it will be understood to those skilled in the art that this invention is also capable of further and other embodiments within the spirit and scope of the appended claims.

I claim:

1. In a turbofan engine having a casing enveloping a compressor, combustor, turbine and augmentor in axial flow relationship, the improvement therein being in the form of a flameholder located in said augmentor of said turbofan engine downstream of said turbine, said flameholder comprising a hollow ring-like structure of annular configuration concentric with the centerline of said turbine, said ring-like structure being open in the direction of said turbine forming a pilot section, a first group of radially disposed hollow gutters extending from said ring-like structure in a direction toward the centerline of said turbine, a second grip of radially disposed hollow gutters extending from said ring-like structure in a direction away from the centerline of said turbine toward said casing of said turbofan engine, an aperture located in said ring-like structure aligned with each of said gutters interconnecting said pilot section with said gutters, said second group of gutters having a vee-shaped angular configurated portion in a direction toward said turbine, said angular configurated portion gradually increasing in angle size along said gutter in the radial direction as a function of its distance from said ring-like structure whereby hot gases produced by said turbine flow to said pilot section and out said radially extending gutters.

2. In a turbofan engine as defined in claim 1 wherein said flameholder further comprises an ignition system located adjacent said annular pilot.

3. In a turbofan engine as defined in claim 1 wherein the width of said gutters remain constant throughout its length in the radial direction.

* * * * *